US006928946B2

(12) United States Patent
Keys

(10) Patent No.: US 6,928,946 B2
(45) Date of Patent: Aug. 16, 2005

(54) REMOTE MOORING PULLEY SYSTEM

(76) Inventor: Hugo Benedict Keys, 8921 Haro Park Terrace, Sidney, B.C. (CA) V8L 3Z3

( * ) Notice: Subject to any disclaimer, the term of this patent is extended or adjusted under 35 U.S.C. 154(b) by 0 days.

(21) Appl. No.: 10/837,689

(22) Filed: May 4, 2004

(65) Prior Publication Data

US 2005/0098079 A1 May 12, 2005

(30) Foreign Application Priority Data

Nov. 10, 2003 (CA) ..... 2448127

(51) Int. Cl.[7] ..... B63B 21/08
(52) U.S. Cl. ..... 114/230.22; 114/199
(58) Field of Search ..... 114/199, 218, 230.22, 114/210; 24/132 R, 134 R

(56) References Cited

U.S. PATENT DOCUMENTS 2,955,560 A * 10/1960 Howington et al. ..... 114/210
3,626,888 A * 12/1971 Cameron et al. ..... 114/199
3,756,565 A * 9/1973 Sakai ..... 254/391
5,168,823 A 12/1992 Sheppard, Jr.
6,182,946 B1 * 2/2001 Rutherford ..... 254/391
6,651,577 B1 11/2003 Gates

* cited by examiner

*Primary Examiner*—Andrew D. Wright

(57) ABSTRACT

An adjustable pulley device which resides on a boat's anchor rope, which, when the anchor has been set offshore, allows an operator to pull the boat from shore to a predetermined point on the anchor rope, and retrieve it. It comprises a housing with an integral pulley sheave and rope arresting mechanism in conjunction with a snap shackle which is tethered to the boat. To use the device, the snap shackle is snapped around the anchor rope between the sheave and the arresting mechanism on the device. As the boat approaches the shore, the anchor is put over side, and with the anchor set, the anchor rope slides through the device and shackle until the arresting mechanism is actuated. The device, now attached to the anchor rope, becomes the turning block which in conjunction with the shackle make up a pulley system to move the boat to and from shore.

6 Claims, 6 Drawing Sheets

6

12
11

14

REMOTE MOORING PULLEY SYSTEM

FIELD OF THE INVENTION

This invention is designed to enable the mooring of a boat away from shore, with a facility for retrieval back to shore by use of the boat's anchor rope.

BACKGROUND OF THE INVENTION

Having a boat tied to shore has always created problems for boaters. In tidal waters for example, a boat tied to shore, if left unattended, will be left high and dry on a falling tide, or will be washed away on a rising tide. Also, on any body of water, if the waves increase in strength, and a boat is tied to shore, it risks serious damage from being banged against the shore environment.

There is a device currently on the market which addresses these problems by using an elastic bungy cord attached to the anchor rope. The anchor is set away from shore, and, as the boat proceeds to its landing spot, the anchor rope stretches. After the passengers have disembarked, the elastic cord pulls the boat away from shore, while a bow rope connects the boat to the shore.

There are problems associated with this product. Firstly, as the boat approaches the shore, the boat operator often needs to be able to stop and raise the engine's drive leg to avoid it contacting the bottom. When this is done, the lack of forward propulsion allows the elastic cord to start pulling the boat back to its anchor. Secondly, due to the limited stretch of the elastic, the boat can be pulled only a short distance from shore which in many cases (large tidal movement, gently sloping shoreline, etc.) may not be sufficient distance. Finally, when the boat is pulled back to its anchored position, the elastic shock cord (which is now under minimal tension) will allow the boat considerable lateral movement in adverse winds of currents. This would be unwanted if anchored in narrow bays or inlets.

U.S. Pat. Nos. 5,168,823 and 6,651,577 both utilize a separate loop of rope which is attached to the anchor rope in order to create a pulley system with the shore. This invention uses only the boat's main anchor rope which, through the device, is converted into a pulley system.

BRIEF SUMMARY OF THE INVENTION

The mooring device is constructed from a stainless steel sheet which is bent to form an open ended box like structure with extended sides and back enclosing a pulley sheave at one end and a rope arresting mechanism at the other. It resides on the boat's anchor rope, and when used in conjunction with a snap shackle which is tethered to the boat, creates a pulley system using the boat's anchor rope to position the boat away from the shore. Because it does not rely on an elastic shock cord, it overcomes all of the problems associated with the previously described system. It is easily handled by one person on the boat, and is adjustable to any distance that the boat needs to be anchored from shore. Also, a firm tension is applied to the rope so that the boat remains stable laterally.

DETAILED DESCRIPTION OF THE INVENTION

Figure 1:
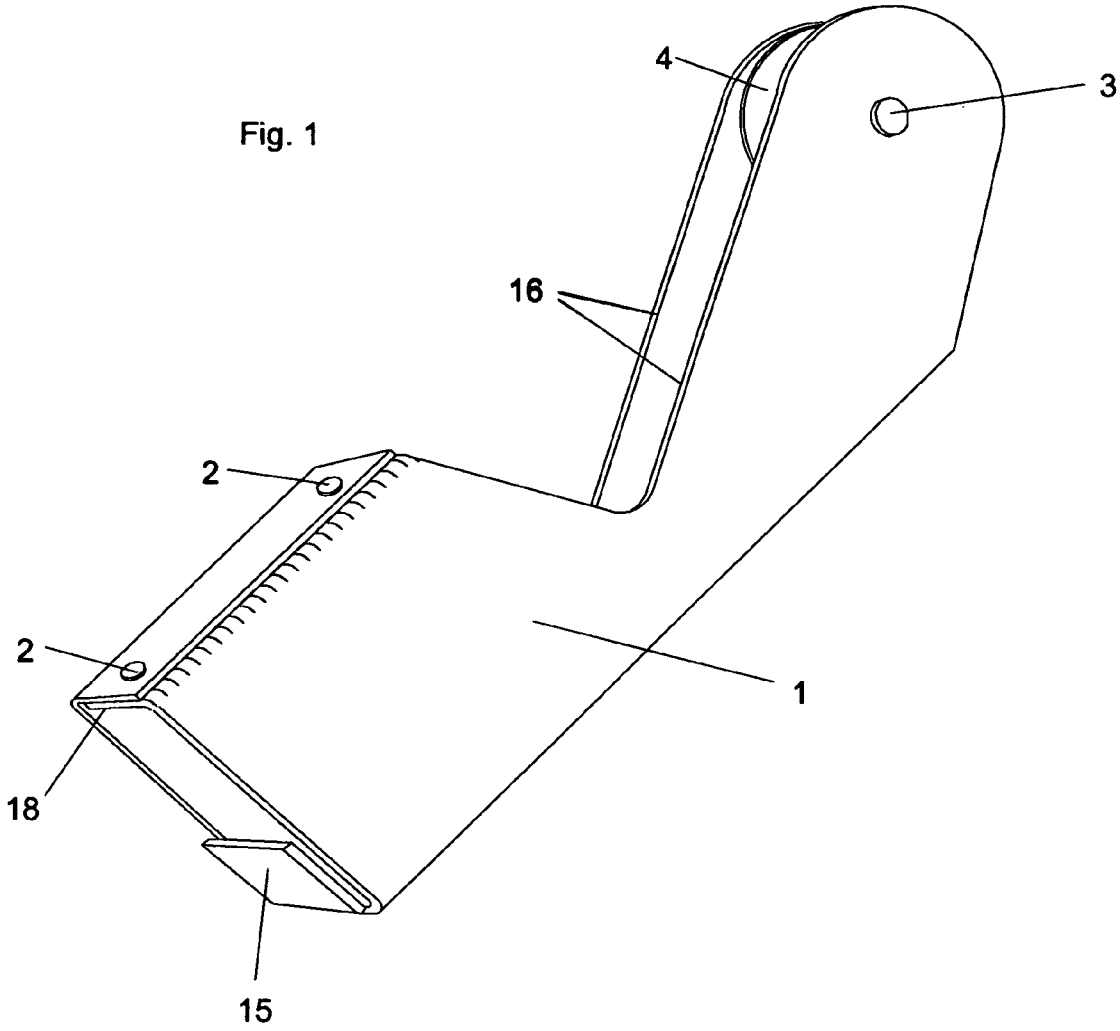
FIG. 1 is a perspective view of the mooring device.
Figure 3:
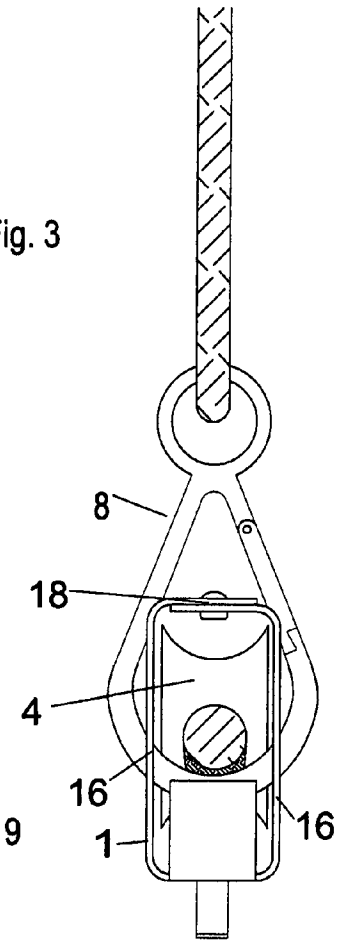
FIG. 3 is a view from the anchor side of the mechanism showing the positioning of the shackle.
Figure 2:
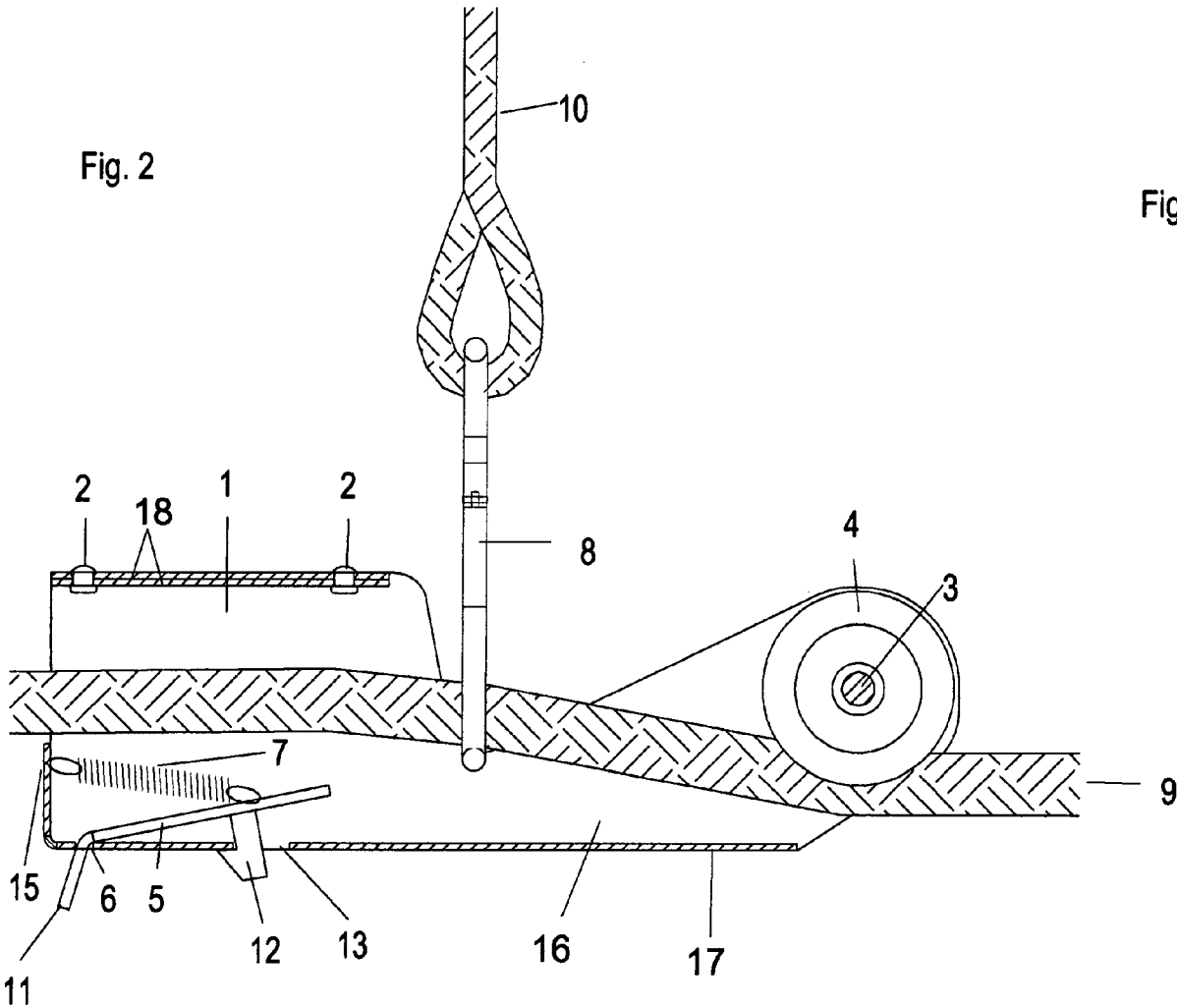
FIG. 2 is a cross sectional side view showing the rope arresting mechanism in the stowed position.

With reference to the drawings, particularly FIGS. 1, 2 and 3, the mooring device comprises a housing 1 fabricated from a stainless steel sheet. The housing is defined by two symmetrical side walls 16, a connecting back 17 extending most of the length of the housing except for allowance for a rope guide slot between the sheave and the back, a spring retaining rope guide 15 and two overlapping flanges 18 which form the top of the housing. The flanges are secured by rivets 2. There is a pulley sheave 4 at one end of the housing which is secured by a spacing rivet 3, which also acts as the axel for the sheave, and a rope arresting mechanism at the opposite end.

The rope arresting mechanism is comprised of a swinging arm 5 with an attached flange 11 and a retaining pawl 12. The flange 11 is angled approximately 60 degrees to the arm, and fits through lateral slot 6 in the back of the housing. The retaining pawl 12 fits through a longitudinal slot 13. The arm assembly is held in position by tension from the actuating spring 7 which is attached between the arm and spring retainer 15. The shackle 8 which is tethered to the boat by rope 10 is snapped onto the anchor rope 9 when the device is to be deployed.

Figures 4, 5, 6, 7:
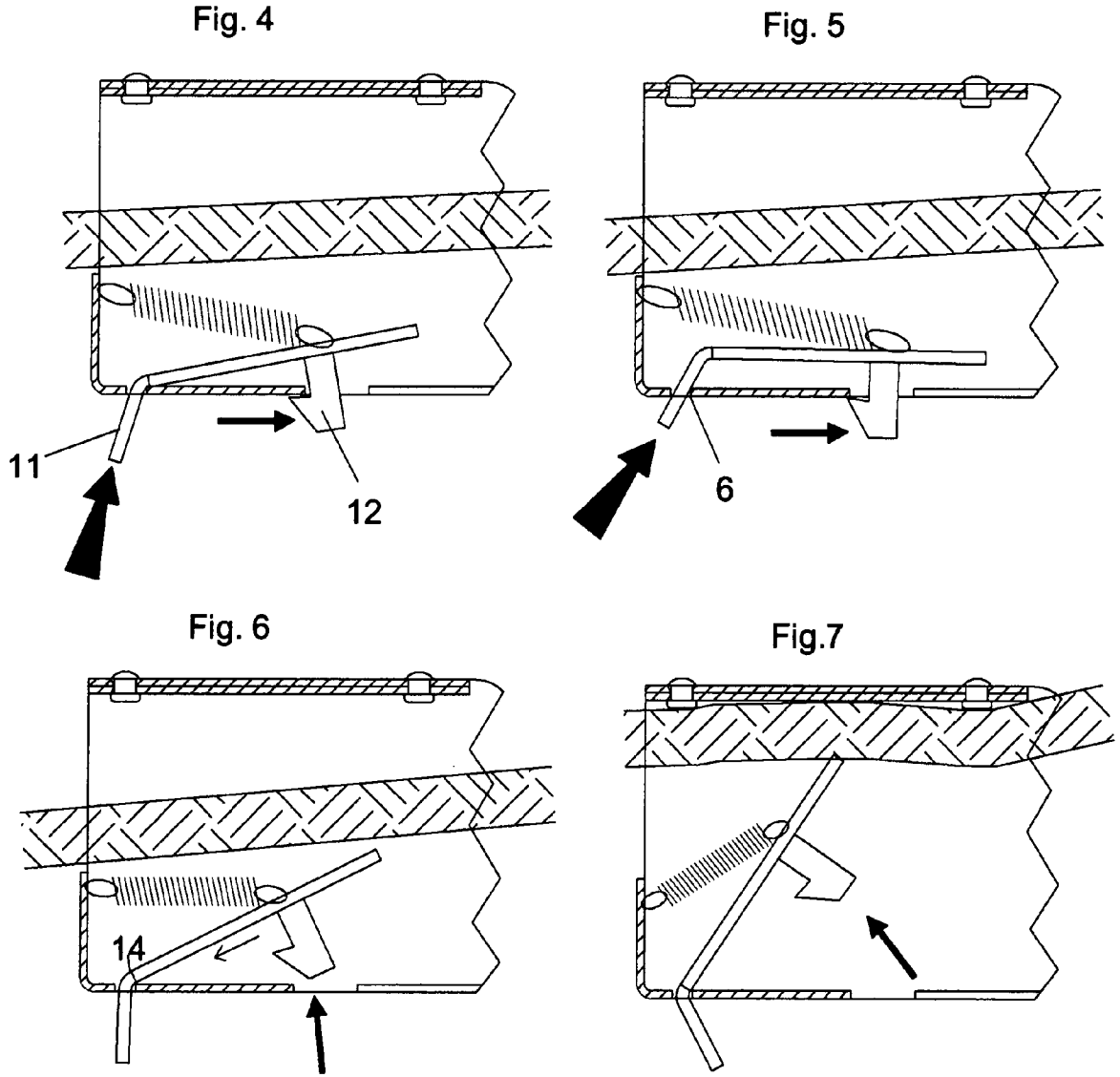
FIGS. 4, 5, 6 and 7 depict the functioning of the rope arresting arm.
Figure 9:
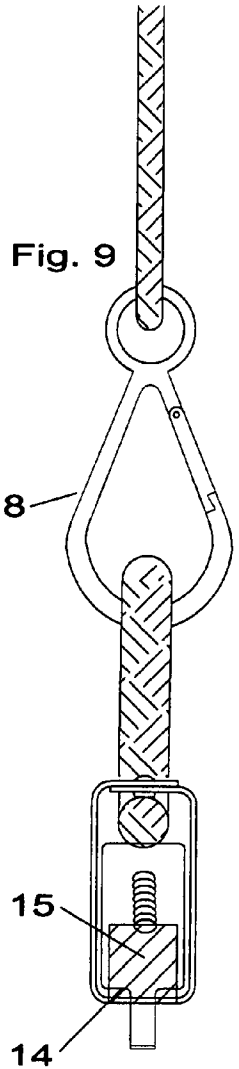
FIG. 9 is the corresponding end view to FIG. 8 with the spring anchor 15 cut away to show the arresting arm shoulders 14 against the housing.
Figure 8:
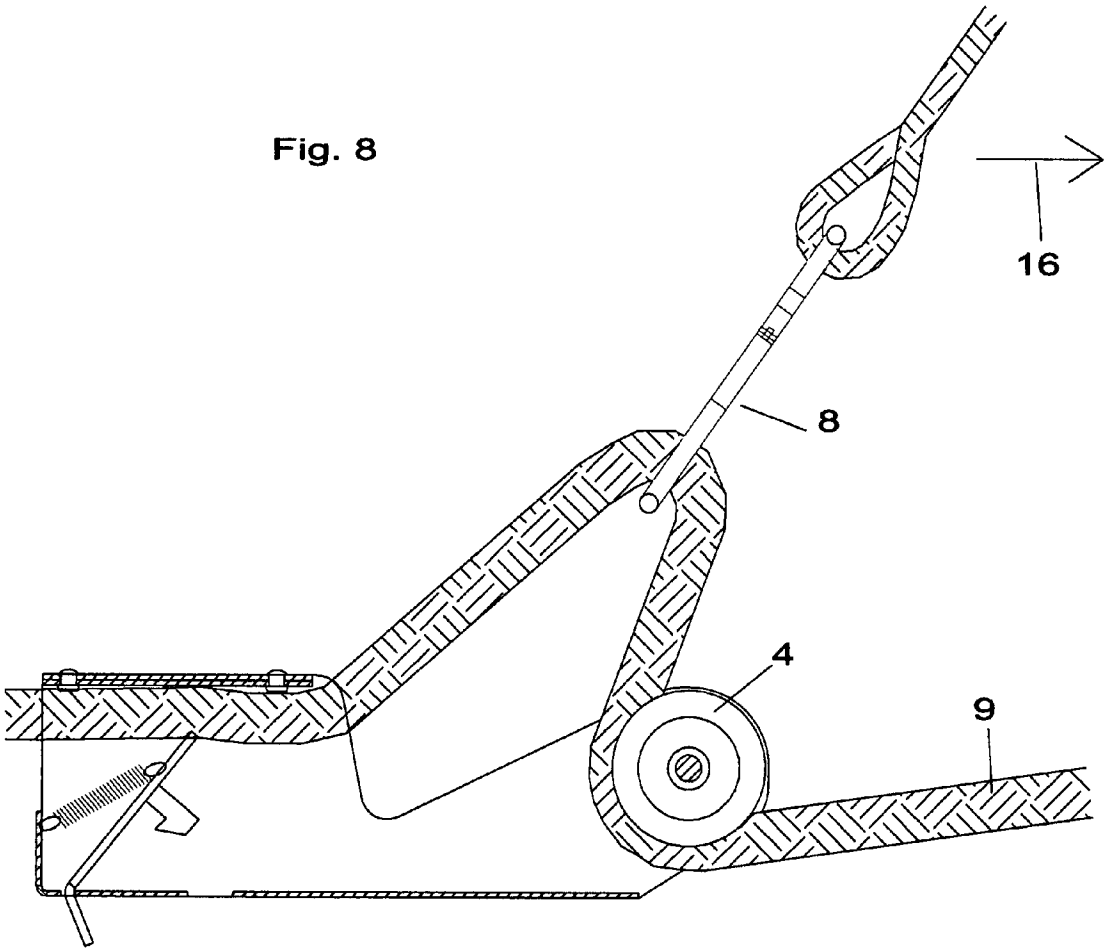
FIG. 8 shows the device after the rope arresting device has been actuated.

The sequence of events to release the arm are depicted in FIGS. 4, 5, 6 and 7. In FIG. 4, the operator applies pressure to the flange 11 (which is acting as a trigger mechanism) in the direction indicated by the bold arrow. This causes the arm to move backwards against the spring pressure until the locking pawl 12 is clear of the back of the device as shown in FIG. 5. Due to the geometry of the arm, this occurs while the end of the flange 11 is still protruding through slot 6 thereby keeping the arm in position. FIG. 6 shows the arm being pulled up and forward by the spring to its pivot point and the shoulders 14 of the arm moving against the back of the housing. FIG. 7 has the arm firmly against the anchor rope and thereby fixing the device to the anchor rope at this point. FIG. 8 shows where the subsequent forward motion of the boat as depicted by arrow 16 pulls the anchor rope 9 from the rope locker or storage bag on the boat, around the sheave 4, and around the shackle 8, creating the pulley system.

Figure 10:
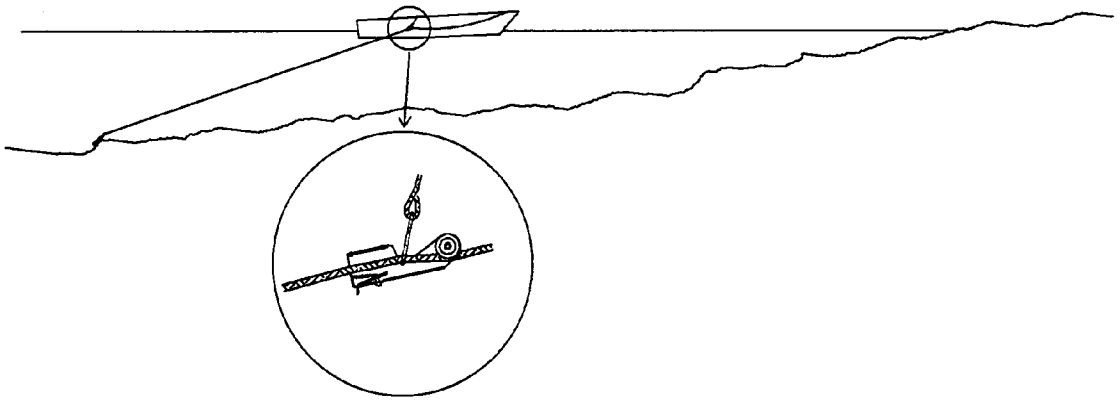
FIGS. 10, 11, 12 and 13 show the sequence of events as the device is used throughout the anchoring process.
Figure 11:
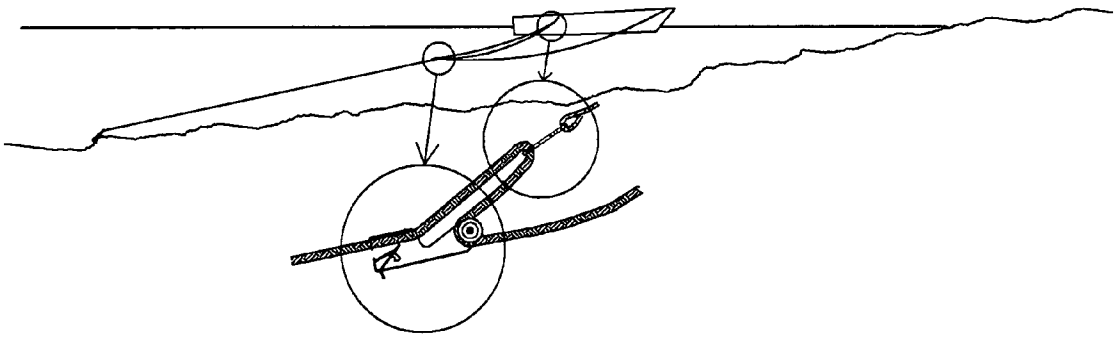

To use the device, the snap shackle is snapped to the anchor rope between the rope arresting mechanism and the sheave in the housing, with the rope arresting arm in the stowed position (as shown in FIG. 2). As the boat approaches the shore where it intends to land, the anchor is set a suitable distance from shore. The anchor rope slides through the device from the anchor locker (usually at the bow of the boat) as the boat proceeds to shore as shown in FIG. 10. At the desired distance from shore (the point where the boat is to be moored), the rope arresting mechanism is activated and the device is released over the side, creating a fixed pulley point on the anchor rope. In FIG. 11, the rope arresting arm has been actuated and the device is now securely positioned on the anchor rope. The shackle has pulled free from the device, and is pulling out the anchor rope from the anchor locker via the pulley on the device.

Figure 12:
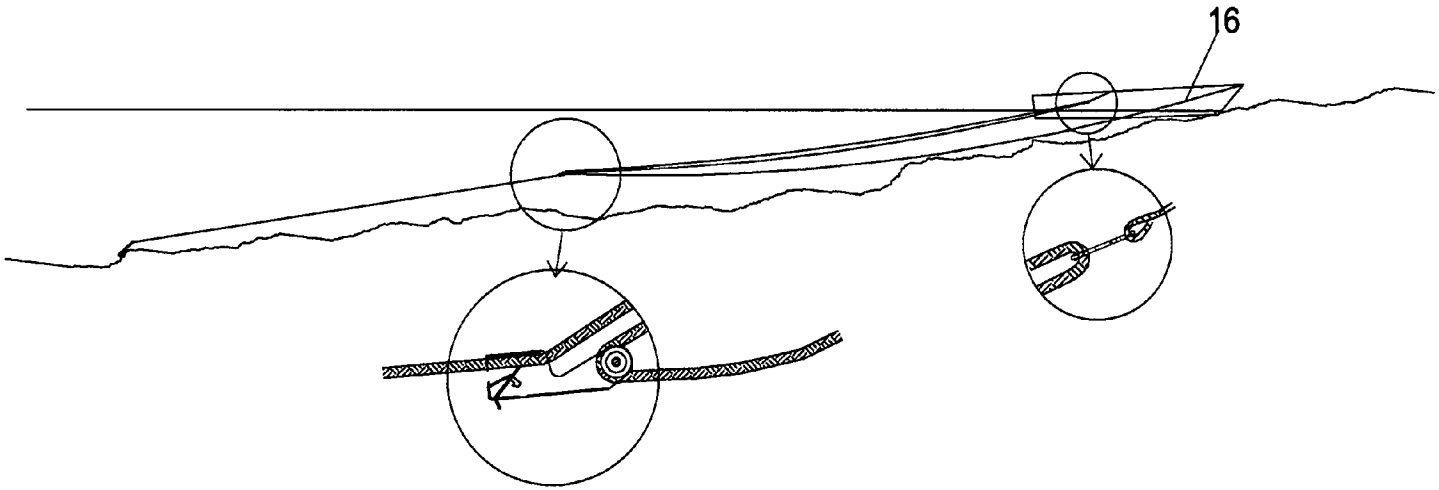
Figure 13:
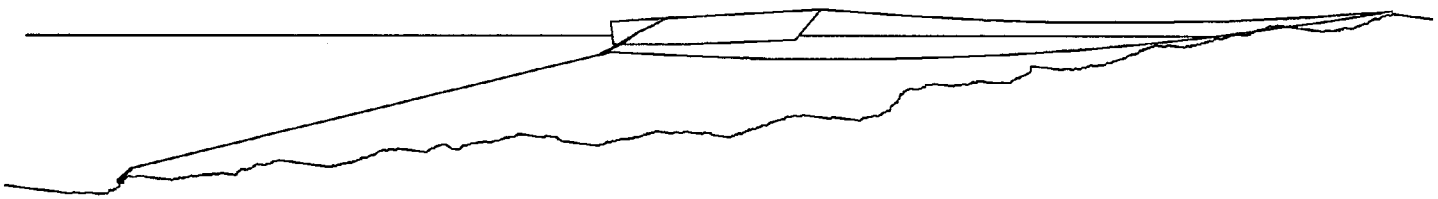

Upon reaching the shore, and disembarking, the anchor rope is then made fast to the bow of the boat (FIG. 12). The length of anchor rope 16 which leads directly to the sheave on the device can then be pulled which will have the effect of pulling the boat backwards (via the pulley on the anchor rope) from the shore to its desired position shown in FIG. 13. Because of the 2 to 1 ratio of the pulley system, there will be an excess of rope on shore after the boat is moored, and this rope is then tied to a convenient anchor point (rock, tree branch, etc.) to secure the boat in position.

To retrieve the boat, the rope is untied from its anchor point on shore, and the length that leads directly to the bow of the boat is used to pull the boat back to shore.

The invention as described provides a convenient adjustable remote mooring pulley system which permanently resides on a boat's anchor rope. Said invention has been described with the preferred embodiment, however, modifications may be made to the invention (fabrication techniques, materials, etc.) which will not depart from the intent and scope of the invention as defined in the following claims.

What is claimed is:

1. A pulley device, comprising:

an elongated housing defined by two symmetrical side walls, a connecting back and a top opposed to the connecting back, the housing having a first end and a second end;

a pulley sheave internally mounted at the first end of the housing;

a rope arresting mechanism internally mounted at the second end of the housing;

an anchor rope guide passage extending between the first end and the second end of the housing, the anchor rope guide passage passing between the pulley sheave and the back of the housing and between the rope arresting mechanism and the top of the housing; and a cut away notched portion being provided in the sides and the top of the housing spaced from the first end, the cut away notched portion being adapted to permit a person to reach in and grab an anchor rope extending through the housing.

2. A pulley device, comprising:

an elongated housing defined by two symmetrical side walls, a connecting back and a top opposed to the connecting back, the housing having a first end and a second end;

a pulley sheave internally mounted at the first end of the housing;

a rope arresting mechanism internally mounted at the second end of the housing;

an anchor rope guide passage extending between the first end and the second end of the housing, the anchor rope guide passage passing between the pulley sheave and the back of the housing and between the rope arresting mechanism and the top of the housing; and a cut away notched portion being provided in the sides and the top of the housing spaced from the first end, the cut away notched portion being adapted to permit a person to reach in and grab an anchor rope extending through the housing;

the rope arresting mechanism comprising a swinging arm, said arm having a pivot end attached to the back of the housing and a free end tensioned by a spring so as to swing the arm upward to the top of the housing, thereby trapping the anchor rope between the top of the housing and the free end of the arm.

3. The pulley device as described in claim 2, wherein the arm has an attached positioning flange which protrudes through a transverse slot in the back of the housing, the flange acting as a releasing trigger for the arm.

4. The pulley device as described in claim 3, wherein the arm is retained by an attached pawl in a position roughly parallel to the back of the housing so as to allow free passage of the anchor rope through the anchor rope guide passage, until the trigger mechanism is actuated which then frees the arm to close against the anchor rope, jamming it against the top of the housing and thereby preventing subsequent movement of the anchor rope through the housing.

5. The pulley device described in claim 2 in combination with an anchor rope, with a snap shackle extending through the cut away notched portion of the housing and attached to the anchor rope between the pulley sheave and the arm.

6. A method, comprising the steps of:

providing a pulley device comprising:

an elongated housing defined by two symmetrical side walls, a connecting back and a top opposed to the connecting back, the housing having a first end and a second end;

a pulley sheave internally mounted at the first end of the housing;

a rope arresting mechanism internally mounted at the second end of the housing;

an anchor rope guide passage extending between the first end and the second end of the housing, the anchor rope guide passage passing between the pulley sheave and the back of the housing and between the rope arresting mechanism and the top of the housing; and a cut away notched portion being provided in the sides and the top of the housing spaced from the first end, the cut away notched portion being adapted to permit a person to reach into the housing and grab an anchor rope extending through the housing;

positioning an anchor rope in the anchor rope guide passage of the pulley device, the anchor rope having a first end and a second end;

securing the first end of the anchor rope to an anchor positioned in water off shore;

locking the pulley device in position on the anchor rope with the rope arresting mechanism;

pulling a loop of rope through the cut away notched portion of the housing and tethering the loop of rope to a stem of a boat to act as a turning block;

securing the second end of the anchor rope to a bow the boat;

pulling on a portion of the anchor rope leading to the pulley from the shore in order to pull the boat back toward the pulley device and away from the shore; and pulling on a portion of the anchor rope leading from the shore to the boat in order to pull the boat away from the pulley device and back to the shore.

* * * * *